US005681224A

United States Patent [19]

Higashi

[11] Patent Number: 5,681,224

[45] Date of Patent: Oct. 28, 1997

[54] AUTOMATIC BUMPER SYSTEM FOR BOWLING

[75] Inventor: Tsunoru Higashi, Ayase, Japan

[73] Assignee: Asahi Engineering & Trading Co., Ltd., Japan

[21] Appl. No.: 764,333

[22] Filed: Dec. 12, 1996

[51] Int. Cl.[6] ..... A63D 5/00

[52] U.S. Cl. ..... 473/109

[58] Field of Search ..... 473/109, 113, 473/114

[56] References Cited

U.S. PATENT DOCUMENTS 4,900,024 2/1990 Chandler et al. ..... 473/109

*Primary Examiner*—William H. Grieb

*Attorney, Agent, or Firm*—Cobrin Gittes & Samuel

[57] ABSTRACT

In construction of a bumper system for bowling including a movable bumper bar adapted for demarcating a lane and a gutter, the bumper bar is selectively and automatically set to operative and stand-by positions by a hydraulic cylinder which is activated on receipt of a drive signal. The drive signal is generated either by players' manual operation on an activation switch at a scoring panel or by a properly programmed control switch circuit. Any conventional, manual bumper system can be automatized by minimal reformation.

3 Claims, 6 Drawing Sheets

AUTOMATIC BUMPER SYSTEM FOR BOWLING

BACKGROUND OF THE INVENTION

The present invention relates to a bumper system arranged along a lane and a gutter in bowling.

In bowling games, a player throws a bowl onto a lane, which rolls along the lane to fall pins arranged at a terminal pin deck. A pair of gutters extend, on both sides of the lane, along the entire length of the lane. Once fall into the gutter, a rolling ball cannot return onto the lane. Stated otherwise, a ball thrown is excluded out of the game after falling into the gutter. Thus, the player controls its throw so that the ball should not fall into the gutter.

It is, however, difficult for an unskilled player such as a kid or an aged person to put perfect control onto a ball to be thrown and, as a consequence, a ball thrown by an unskilled player is liable to fall into gutters. Too frequent fall of a ball into gutters does not allow the players fully enjoy their games.

In order to remove such an inconvenience, it is employed to arrange a bumper bar along a border between a lane and an associated gutter in order to inhibit fall of a ball into the gutter. At the border between the lane and the gutter, the bumper bar extends in parallel to the both. The bumper bar is adapted for movement between an operative position to demarcate the lane and the gutter and a stand-by position not to demarcate the two. One commercial example is a product named "G -Π DURA BUMPER BOWLING" produced by AMF in Tokyo, Japan.

When a skilled player plays games, the bumper bar is set to the stand-by position to form no demarcation between the lane and the gutter, i.e. the bumper system is out of operation. Then, the skilled player can enjoy ordinary games. When an unskilled player plays games, the bumper bar is set to the operative position to form a demarcation between the lane and the gutter, i.e. the bumper system is in operation. Then, the unskilled player can enjoy adjusted games in which no balls are allowed to fall into gutters.

In the case of the above-described conventional bumper systems, its bumper bar is manually set to the operative and stand-by positions. At every shift in position of the bumper system, a player or a bowling operator needs to go out to the lane in order to operate the system manually. That is, one needs to move the bumper bar manually between the operative and stand-by positions. This operation is very troublesome. In particular when skilled players and unskilled players play alternately together on a same lane, shift in position of the bumper system needs to be carried out from player to player, thereby making the operation more troublesome.

It is also proposed to perform such an operation in an automatic fashion. But, most of the conventional automatic systems necessitate use of complicated electric control circuits and, as a result, are very high in production cost. There is no automatic systems which allow use of the conventional, manual arrangement only with simple reformation.

SUMMARY OF THE INVENTION

It is thus the basic object of the present invention to enable automation of a conventional, manual bumper system with minimal reformation.

In accordance with the basic aspect of the present invention, an elongated base block is fixed in parallel along a lane; a bumper bar is arranged extending along the lane substantially over its entire length; a hydraulic cylinder is joined at its distal pivot to the base block in order to project and retract its plunger on receipt of a drive signal; a drive arm is joined at its distal pivot to the bumper bar, at its proximal pivot to the distal end of the plunger of the hydraulic cylinder, and at its intermediate pivot to the base block; and at least one connecting arm is joined at its distal pivot to the bumper bar and its proximal pivot to the base block to maintain the bumper bar always in parallel to the base block.

The drive signal can be generated by manual operation on an activation switch arranged at a score panel for players. It can also be generated by properly programmed control signals or properly designed sequence signals.

As a drive signal is received to command bumper operation, the plunger of the hydraulic cylinder projects, the drive arm swings in the first direction on the base block and pushes out the bumper bar to the operative position remote from the base block to demarcate the lane and the gutter. As a drive signal is received to command no bumper operation, the plunger of the hydraulic cylinder retracts, the drive arm swings on the base block in the second direction opposite to the first direction and pull in the bumper bar to the stand-by position close to the base block not to demarcate the lane and the gutter.

DESCRIPTION OF THE PREFERRED EMBODIMENTS

Figure 1:
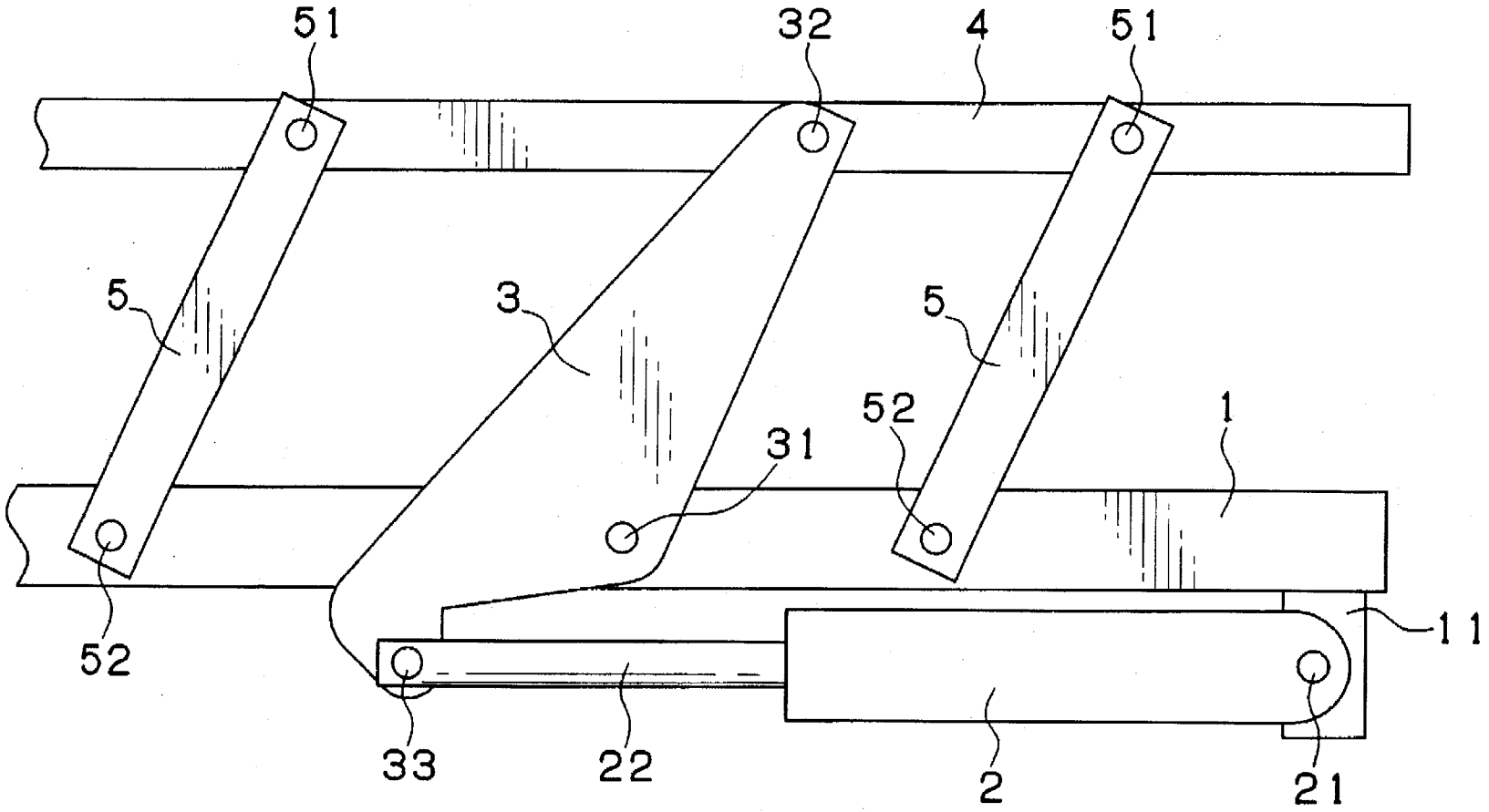
FIG. 1 is a top plan view of one embodiment of the bumper system in accordance with the present invention with its bumper bar in the operative position.

The basic construction of one embodiment of the bumper system in accordance with the present invention is shown in FIG. 1, in which the bumper system is arranged on one side of and along a lane. In the case of the illustrated arrangement, a bumper bar is designed to move in a horizontal direction to demarcate a lane and a gutter. The bumper bar may move in a vertical direction for demarcation between the lane and the gutter. The present invention is well applicable to either of the two fashions.

A base block 1 is fixed at a position by the side of a lane (not shown) whilst extending in parallel to the lane. The base block 1 is provided with a bracket 11 to which a hydraulic cylinder 2 is joined at a proximal pivot 21. That is, the hydraulic cylinder 2 is swingable about the proximal pivot 21. The distal end of a plunger 22 of the hydraulic cylinder 2 is joined to a drive arm 3 at a proximal pivot 33.

The drive arm 3 extends towards the lane and its distal end is joined to a bumper bar 4 at a distal pivot 32. The drive arm 3 is joined to the base block 1 at an intermediate pivot 31 located between the two end pivots 32 and 33.

A plurality of connecting arms 5 are arranged whilst bridging the base block 1 and the bumper bar 4. Each connecting arm 5 is joined at a distal pivot 51 to the bumper bar 4 and at a proximal pivot 52 to the base block 1. The connecting arms 5 operate to maintain the bumper bar 4 always in parallel to the base block 1.

Operation will now be described in reference to FIGS. 1 and 2. In the condition shown in FIG. 1, the bumper bar 4 is set to the operative position to demarcate the lane and the gutter. Under this condition, a drive signal is put in a valve controller of the hydraulic cylinder 2 to command bumper operation and the plunger 22 of the hydraulic cylinder 2 projects. The drive arm 3 is swung in the first direction (rightwards in the illustration) about the intermediate pivot 31 to set the bumper bar 4 to the operative position.

Figure 2:
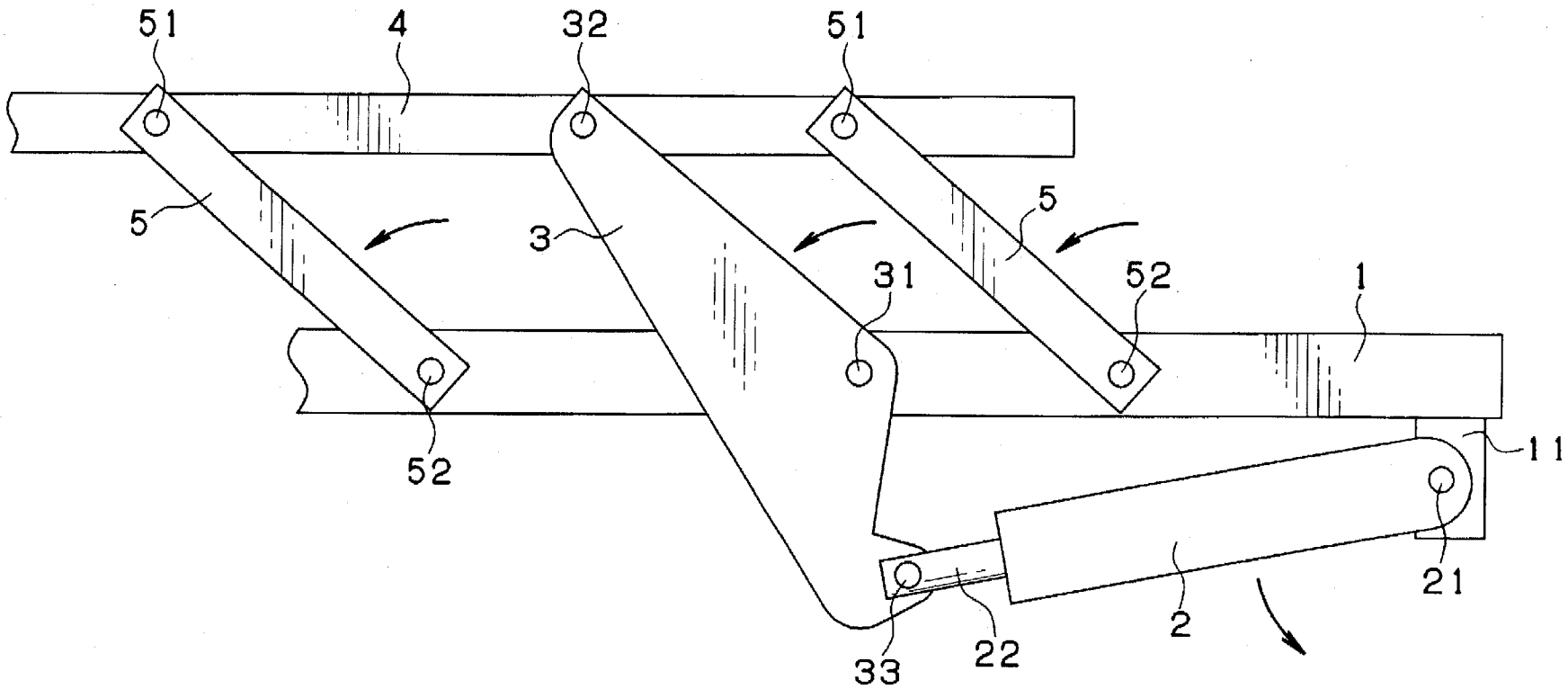
FIG. 2 is a top plan view of the same bumper system with its bumper bar in the stand-by position.

In the condition shown in FIG. 2, the bumper bar 4 is set to the stand-by position not to demarcate the lane and the gutter. Under this condition, a drive signal is put in the valve controller of the hydraulic cylinder 2 to command no bumper operation and the plunger 22 of the hydraulic cylinder 2 retracts. The drive arm 3 is accordingly swung in the second direction (leftwards in the illustration) about the intermediate pivot 31 to set the bumper bar 4 to the stand-by position. Following this swing of the drive arm 3, the connecting arms 5 swing in the same direction to maintain the bumper bar 4 in parallel to the base block 1.

Figure 3:
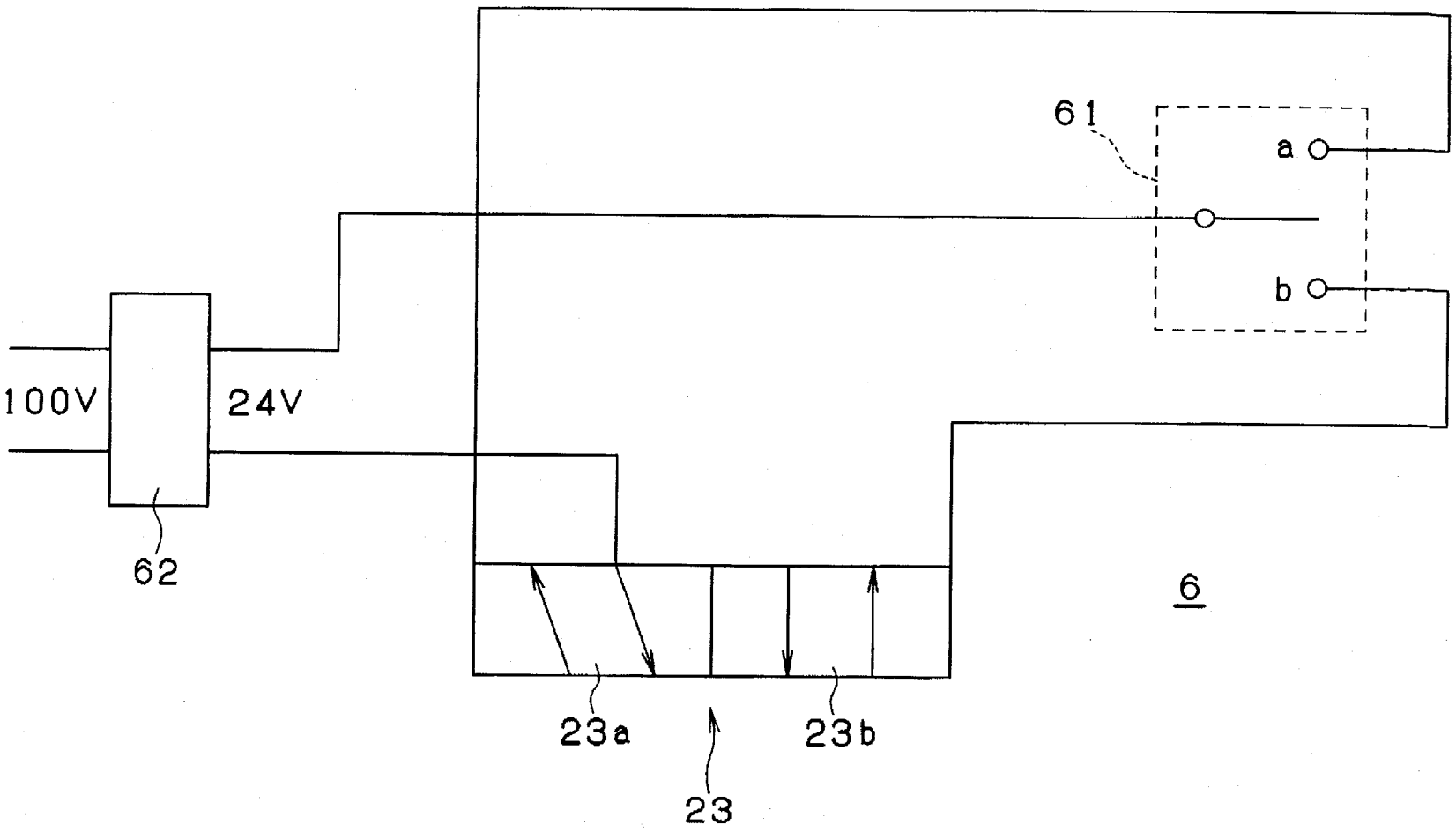
FIG. 3 is a circuit diagram of one embodiment of the drive signal generating circuit for the hydraulic cylinder.

One embodiment of the drive signal generating circuit is shown in FIG. 3, which is used for control of a bumper bar arranged on one side of a lane only. The drive signal generating circuit 6 includes one activation switch 61 used for selective activation of a valve controller 23. The first contact "a" of the activation switch 61 is connected to a projection drive 23*a* of the valve controller 23 for the hydraulic cylinder whereas the second contact "b" is connected to a retraction drive 23*b* of the valve controller 23. The activation switch 61 is generally arranged at a scoring panel for operation by players.

As the activation switch 61 is operated to close the contact "a", the projection drive 23*a* of the valve controller 23 is activated to introduce operating fluid and the plunger 22 of the hydraulic cylinder 2 projects to set the drive arm 3 to the position shown in FIG. 1. As a result, the bumper bar 4 is set to the operative position.

As the activation switch 61 is operated to close the contact "b", the retraction drive 23*b* of the valve controller 23 is activated to introduce the operating fluid and the plunger 22 of the hydraulic cylinder 2 retracts to set the drive arm 3 to the position shown in FIG. 2. As a result, the bumper bar 4 is set to the stand-by position.

Figure 4:
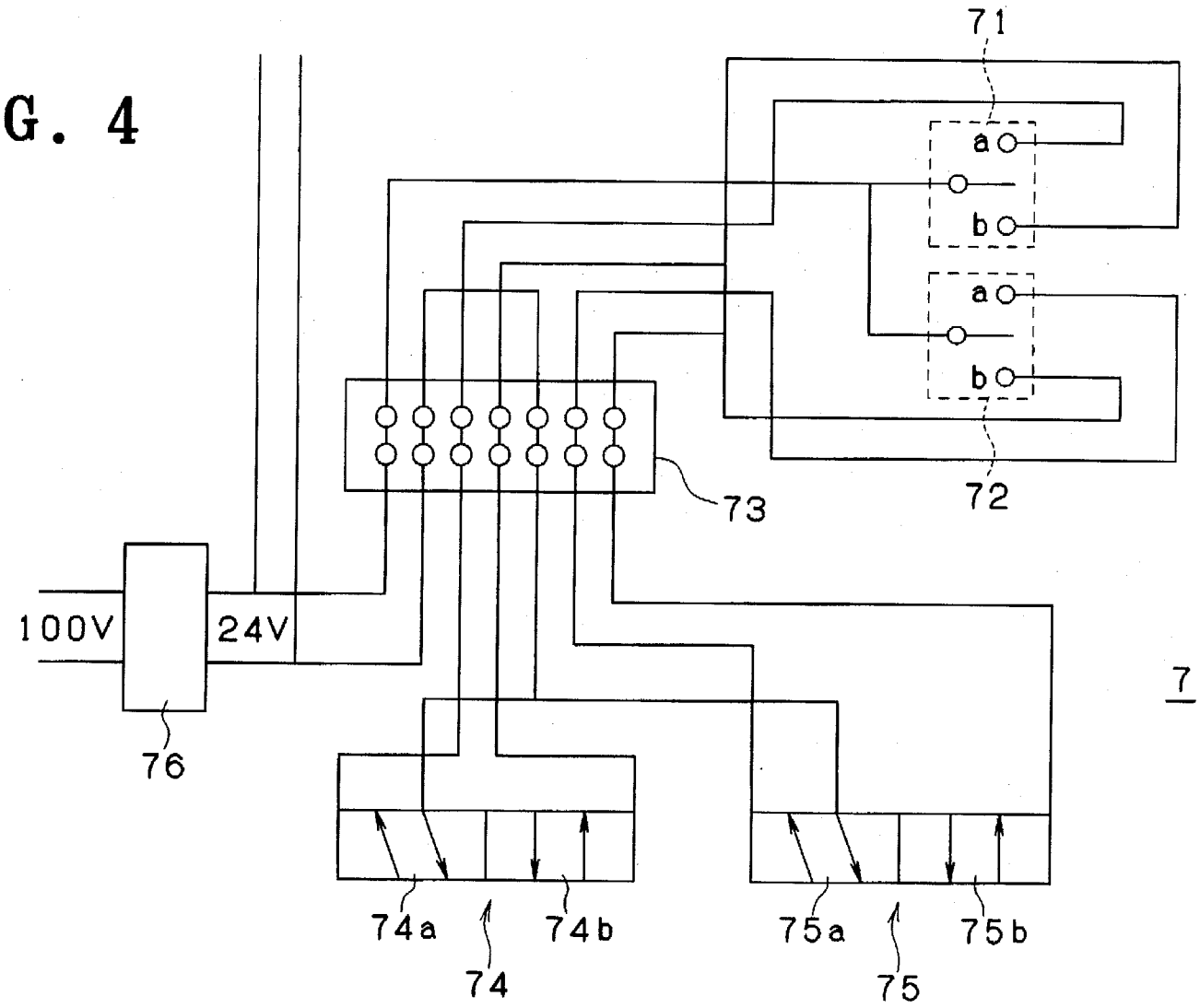
FIG. 4 is a circuit diagram of another embodiment of the drive signal generating circuit.

Another embodiment of the drive signal generating circuit is shown in FIG. 4, which is used for control of bumper bars arranged on both sides of a lane. The drive signal generating circuit 7 includes two activation switches 71 and 72 used for selective activation of valve controllers 74 and 75. The first contact "a" of the first activation switch 71 is connected via a terminal block 73 to a projection drive 74*a* of the first valve controller 74 whereas the second contact "b" is connected to a retraction drive 74*b* of the valve controller 74. Similarly, the first contact "a" of the second activation switch 72 is connected via the terminal block 73 to a projection drive 75*a* of the second valve controller 75 whereas the second contact "b" is connected to a retraction drive 75*b* of the valve controller 75. Like the foregoing embodiment, the activation switches 71 and 72 are arranged at a scoring panel for operation by players. The operation is substantially same as that of the circuit 6 shown in FIG. 3.

Figure 5:
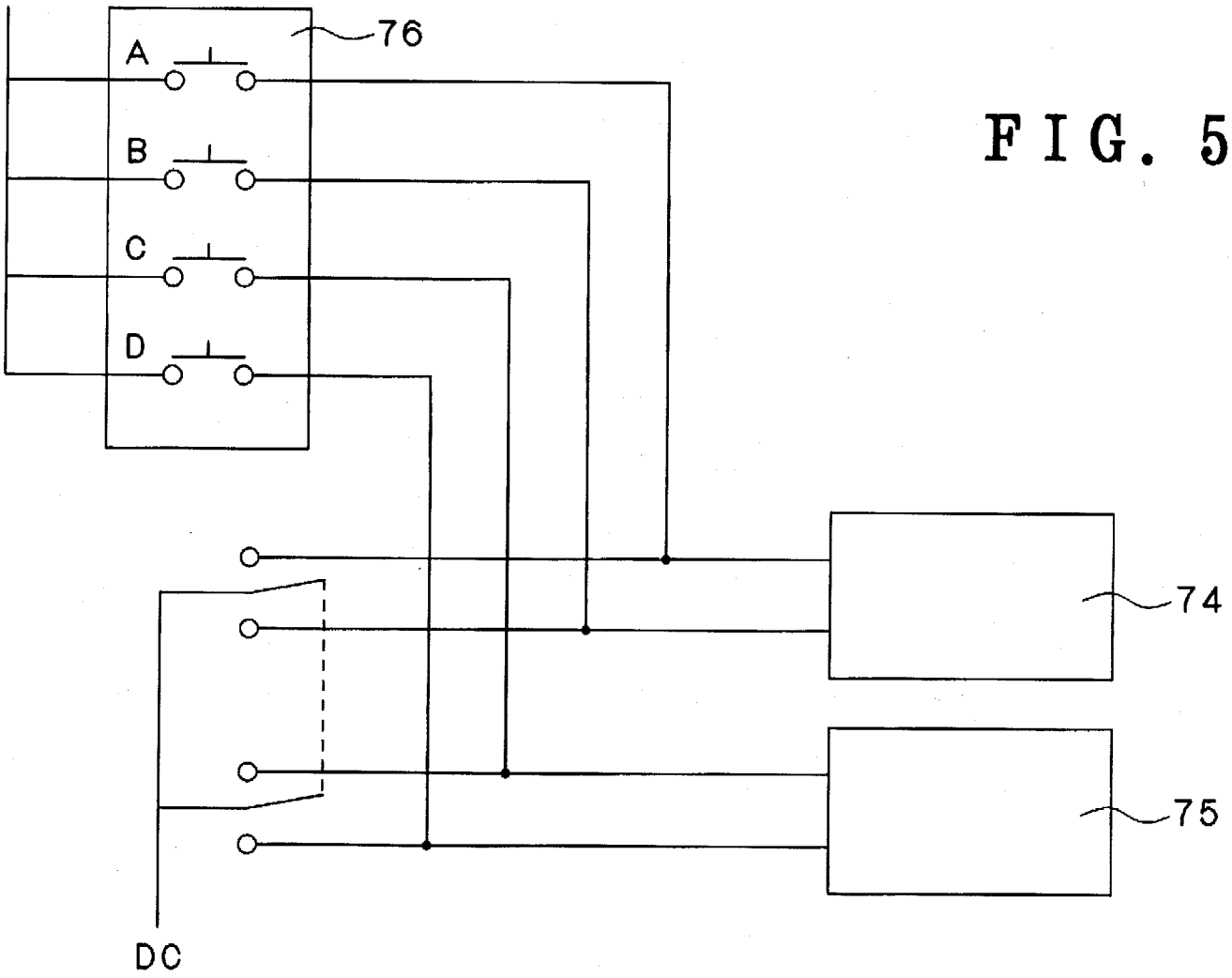
FIG. 5 is a circuit diagram of the other embodiment of the drive signal generating circuit.

In the case of the above-described embodiments, the drive signal for the hydraulic cylinder(s) is generated by players' manual operation on the activation switch(es) arranged at the scoring panel. As an alternative, the drive signal may be generated by a properly programmed control signal circuit. One example of such a control signal circuit is shown in FIG. 5, in which bumper systems are arranged on both sides of a lane.

The first and second valve controllers 74, 75 are connected to a power source DC and driven for operation by drive signals generated by a control box 76. Control signals are supplied to the control box by players' manual operation on a proper switch arranged at the scoring panel. The operation will now be described in reference to FIGS. 6 and 7, in which time is taken on the abscissa and control signals are taken on the ordinate. A game is started at a timing T1 and finished at a timing T2.

Figure 6:
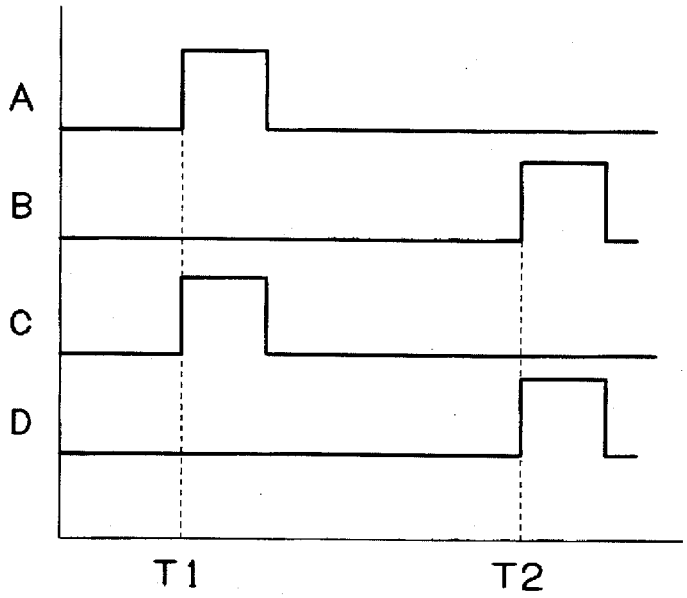
FIG. 6 is a graph for showing one mode of its operation.

In the case of the operation mode shown in FIG. 6, the bumper systems are always in operation throughout the game. Concurrently with starting of the game, control signals are put in to switches A and C at the control box 76, the projection drives of both valve controllers 74 and 75 are activated to allow introduction of the operating fluid, and plungers of the corresponding hydraulic cylinders project to set the associated bumper bars to their operative positions. That is, the bumper systems are concurrently brought into operation on both sides of the lane.

When the game is finished, control signals are put in to switches B and D at the control box 76, the retraction drives of both valve controllers 74 and 75 are activated to allow introduction of the operating fluid, and the plungers of the hydraulic cylinders retract to set the bumper bars to their stand-by positions. That is, the bumper systems are concurrently brought out of operation on both sides of the lane.

Figure 7:
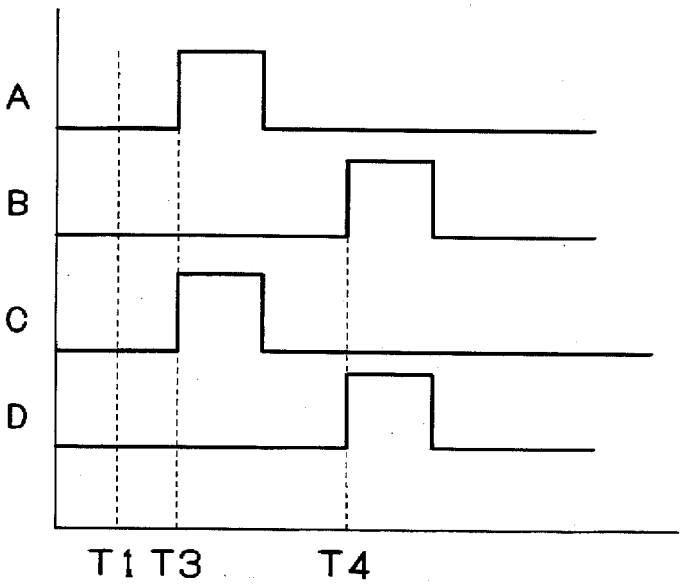
FIG. 7 is a graph for showing another mode of its operation.

In the case of the operation mode shown in FIG. 7, the bumper system is kept in operation only for a specified (unskilled) player. At starting (T1) of the game, the bumper system is set to be out of operation. When the specified player starts his or her game at T3, control signals are put in to the switches A and C, the projection drives of the valve controllers 74 and 75 are activated to allow introduction of the operating fluid, and the plungers of the hydraulic cylinders project to set the bumper bars to their operative positions. That is, the bumper systems are concurrently and provisionally brought into operation on both sides of the lane.

As the game of the specified player is over at T4, control signals are put in to the switches B and D, the retraction drives of the valve controllers 74 and 75 are activated to allow introduction of the operating fluid, and the plungers of the hydraulic cylinders retract to set the bumper bars to their stand-by positions. That is, the bumper systems are concurrently brought out of operation on both sides of the lane.

In an alternative, a bumper system may also be designed to be brought into operation on detection of approach of a ball to a gutter or to the bumper system. The bumper system may be brought out of operation as the ball rolls away from the gutter or the bumper system.

In a construction to pivot the hydraulic cylinder 2 to the base block 1, a pivot pin may preferably be combined with a slot in order to leave a slight play in the coupling. Presence of such a play at the pivot well absorbs shock caused by a ball hitting the bumper 4. Such a construction may also be employed at the joint between the plunger of the hydraulic cylinder and the drive arm.

As is clear from the foregoing descriptions, setting of a bumper bar can be performed only by players' switching operation at the score panel, thereby totally automatizing shifting in operation of a bumper system. In addition, any conventional manual type bumper systems can by easily automatized only by simple reformation.

I claim:

1. An automatic bumper system for bowling comprising an elongated base block fixed in parallel along a lane, a bumper bar extending along said lane substantially over its entire length, a hydraulic cylinder joined at its proximal pivot to said base block and adapted for projecting and retracting its plunger on receipt of a drive signal, a drive arm joined at its distal pivot to said bumper bar, at its proximal pivot to a distal end of said plunger, and at its intermediate pivot to said base block, and at least one connecting arm joined at its distal pivot to said bumper bar and at its proximal pivot to said base block to maintain said bumper bar always in parallel to said base block.

2. An automatic bumper system as claimed in claim 1 in which said drive signal for said hydraulic cylinder is generated by players' manual operation on an activation switch arranged at a scoring panel.

3. An automatic bumper system as claimed in claim 1 in which said drive signal for said hydraulic cylinder is generated by a programmed control signal circuit.

* * * * *